US012116792B2

(12) United States Patent
Wang

(10) Patent No.: US 12,116,792 B2
(45) Date of Patent: Oct. 15, 2024

(54) PORTABLE DEMOLITION DEVICE

(71) Applicant: Zhenkun Wang, Marblehead, MA (US)

(72) Inventor: Zhenkun Wang, Marblehead, MA (US)

( * ) Notice: Subject to any disclaimer, the term of this patent is extended or adjusted under 35 U.S.C. 154(b) by 357 days.

(21) Appl. No.: 17/870,432

(22) Filed: Jul. 21, 2022

(65) Prior Publication Data

US 2024/0011311 A1 Jan. 11, 2024

Related U.S. Application Data

(63) Continuation of application No. PCT/CN2022/104006, filed on Jul. 5, 2022.

(51) Int. Cl.
*E04G 23/08* (2006.01)
*F25D 31/00* (2006.01)

(52) U.S. Cl.
CPC ..... *E04G 23/08* (2013.01); *F25D 31/002* (2013.01); *F25D 31/005* (2013.01)

(58) Field of Classification Search
CPC ..... E04G 23/08; E04G 23/081; F25D 11/003; F25D 31/005; F25D 31/002
See application file for complete search history.

(56) References Cited

U.S. PATENT DOCUMENTS

2010/0218532 A1* 9/2010 Beliczynski ..... A45C 15/00 62/457.1

FOREIGN PATENT DOCUMENTS

CN 209449948 U * 10/2019
JP S6114393 A * 10/1986
JP H05118188 A * 5/1993

OTHER PUBLICATIONS

U.S. Appl. No. 17/870,432, filed Sep. 5, 2024_CN_2600750_Y_M.pdf (Year: 2004).*

* cited by examiner

*Primary Examiner* — Frantz F Jules
*Assistant Examiner* — Martha Tadesse
(74) *Attorney, Agent, or Firm* — WPAT, PC

(57) ABSTRACT

A portable demolition device is based on that the volume of water increases after cooling and freezing. A silicone bag is used to inject controllable water into the designated gap position, and a compressor is used to cool the water through heat conduction until the water freezes. When the water freezes to ice, the ice enlarges the gap. Then another portable demolition device or a replaced silicone bag is used to further enlarge the gap with water until a demolition is complete. The invention has the following advantage: 1. Stable. Compared with other demolition tools, the invention can accurately control the position, direction and force to be demolition. 2. Large-scale demolition can be completed by using a plurality of the invention together, such as directional demolition of an entire building. 3. It is easier to control the direction and strength in large-scale demolition, so that the safety is greatly improved.

10 Claims, 4 Drawing Sheets

PORTABLE DEMOLITION DEVICE

FIELD OF THE INVENTION

The invention relates to the field of tools and instruments, and more particularly to a portable demolition device.

BACKGROUND OF THE INVENTION

People have always hoped that there is a stable and safe demolition tool, which is small enough to remove a rusty screw, pipe valve or large enough to demolish a building. Conventionally, the demolition is either performed by forceful destructive demolition with sharp tools or with explosives. The stability of the demolition is not enough, the destructiveness is too strong, and there are many hidden safety hazards in the process of demolition.

SUMMARY OF THE INVENTION

The portable demolition device of the invention is based on the principle that the volume of water will increase after cooling and freezing. Specifically, a silicone bag is used to inject controllable water into the designated gap position, and then a compressor is used to cool the water through heat conduction until the water freezes. When the water freezes to ice, the ice enlarges the gap. Then another same portable demolition device or a replaced silicone bag is used to further enlarge the enlarged gap with water, and the injected water freezes again until a demolition is complete, so as to achieve the purpose of demolition.

The invention provides a portable demolition device having an appearance of a box of a suitcase. The portable demolition device includes a water inlet, a water outlet pipe, a silicone bag, a compressor, and a heating plate. The water inlet is provided at a lower part of a first side of the box of the suitcase and configured to supply water into the box of the suitcase. The water outlet pipe is provided on a second side of the box of the suitcase and configured to supply the water out of the box of the suitcase. The first side is opposite to the second side. The silicone bag is provided on the second side of the box of the suitcase and connected to the water outlet pipe. The compressor is provided in the box of the suitcase and configured to cool the water in the box of the suitcase. The heating plate is provided in the box of the suitcase and configured to heat the water in the box of the suitcase with an operation of the compressor. By configuring the compressor to cool the water in the box of the suitcase, the water in the silicone bag is converted from a liquid state to a solid state through heat conduction. By configuring the compressor and the heating plate to heat the water in the box of the suitcase, the water in the silicone bag is converted from the solid state to the liquid state through heat conduction.

In one embodiment of the invention, the aforementioned portable demolition device further includes a handle and a plurality of pulleys. The handle is provided at a top of the box of the suitcase. The plurality of pulleys is provided at a bottom of the box of the suitcase. The box of the suitcase is movable by a user through the handle and the plurality of pulleys.

In one embodiment of the invention, the aforementioned portable demolition device further includes a water control valve, provided at the lower part of the first side of the box of the suitcase and connected to the water inlet. The water control valve is configured to control the water inlet to be open and close.

In one embodiment of the invention, the water starts to flow into the box of the suitcase when the water control valve opens the water inlet.

In one embodiment of the invention, the water stops flowing into the box of the suitcase when the water control valve closes the water inlet.

In one embodiment of the invention, the aforementioned portable demolition device further includes an external power cord, provided at the bottom of the box of the suitcase and connected to a power source.

In one embodiment of the invention, the aforementioned portable demolition device further includes a cooling medium, provided in the box of the suitcase and configured to keep the water in the box of the suitcase at a lower temperature.

In one embodiment of the invention, the aforementioned portable demolition device further includes a throttle capillary, provided in the box of the suitcase and connected to the water outlet pipe.

In one embodiment of the invention, the throttle capillary is back-shaped.

In one embodiment of the invention, the silicone bag is placed where to be demolished, and a volume of the silicone bag increases when the water in the silicone bag is converted from the liquid state to the solid state.

In one embodiment of the invention, the volume of the silicone bag decreases when the water in the silicone bag is converted from the solid state to the liquid state.

The portable demolition device of the invention has the following advantage:

1. Stable. Compared with other demolition devices, the portable demolition device of the invention can accurately control the position, direction and force (based on the size of the gap) to be demolition.

2. Large-scale demolition can be completed by using a plurality of portable demolition devices of the invention at the same time, such as directional demolition of an entire building.

3. It is easier to control the direction and strength in large-scale demolition, that is, a building can be gradually tilted in the predetermined direction in the process, which is completely different from the one-time blasting of explosives, thereby greatly improving the safety.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
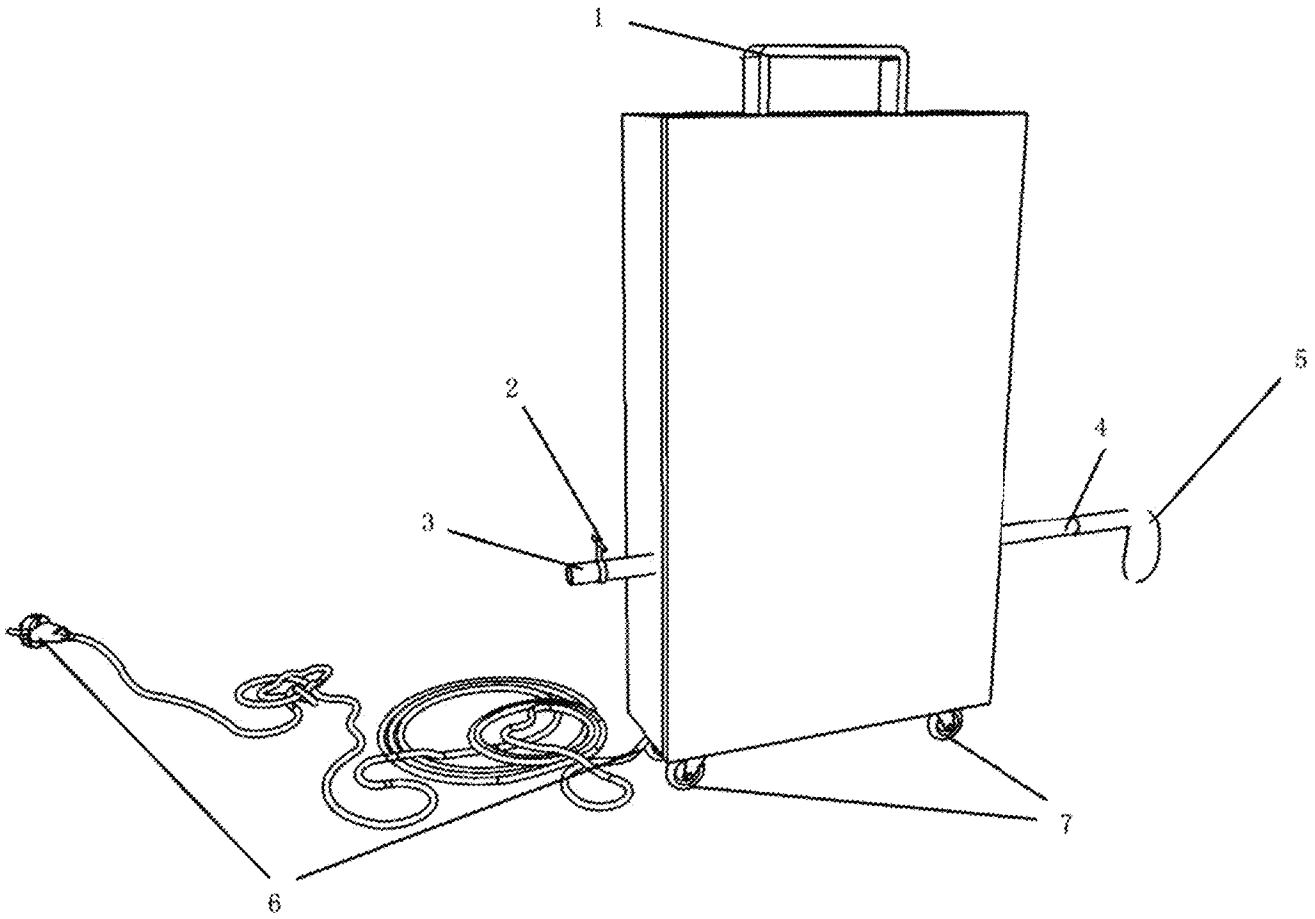
FIG. 1 is a schematic diagram of an appearance of a demolition device according to an embodiment of the invention.

FIG. 1 is a schematic diagram of the appearance of a demolition device according to an embodiment of the invention. It can be seen from FIG. 1 that the appearance of the demolition device of the present invention is a rectangular suitcase with pulleys. As shown in FIG. 1, the demolition device of this embodiment includes a handle 1, a water control valve 2, a water inlet 3, a water outlet pipe 4, a silicone bag 5, an external power cord 6 and a plurality of pulleys 7. The entire demolition device can be moved freely and conveniently by grasping the handle 1 of the suitcase. The handle 1 is provided at the top of the box of the suitcase. The water control valve 2 and the water inlet 3 are provided at the lower part of one side of the box of the suitcase. The water outlet pipe 4 and the silicone bag 5 are provided on the other side of the box of the suitcase. The external power cord 6 and the plurality of pulleys 7 are provided at the bottom of the box of the suitcase. In one embodiment, the water outlet pipe 4 may be pipe made of thermally conductive copper.

Figure 2:
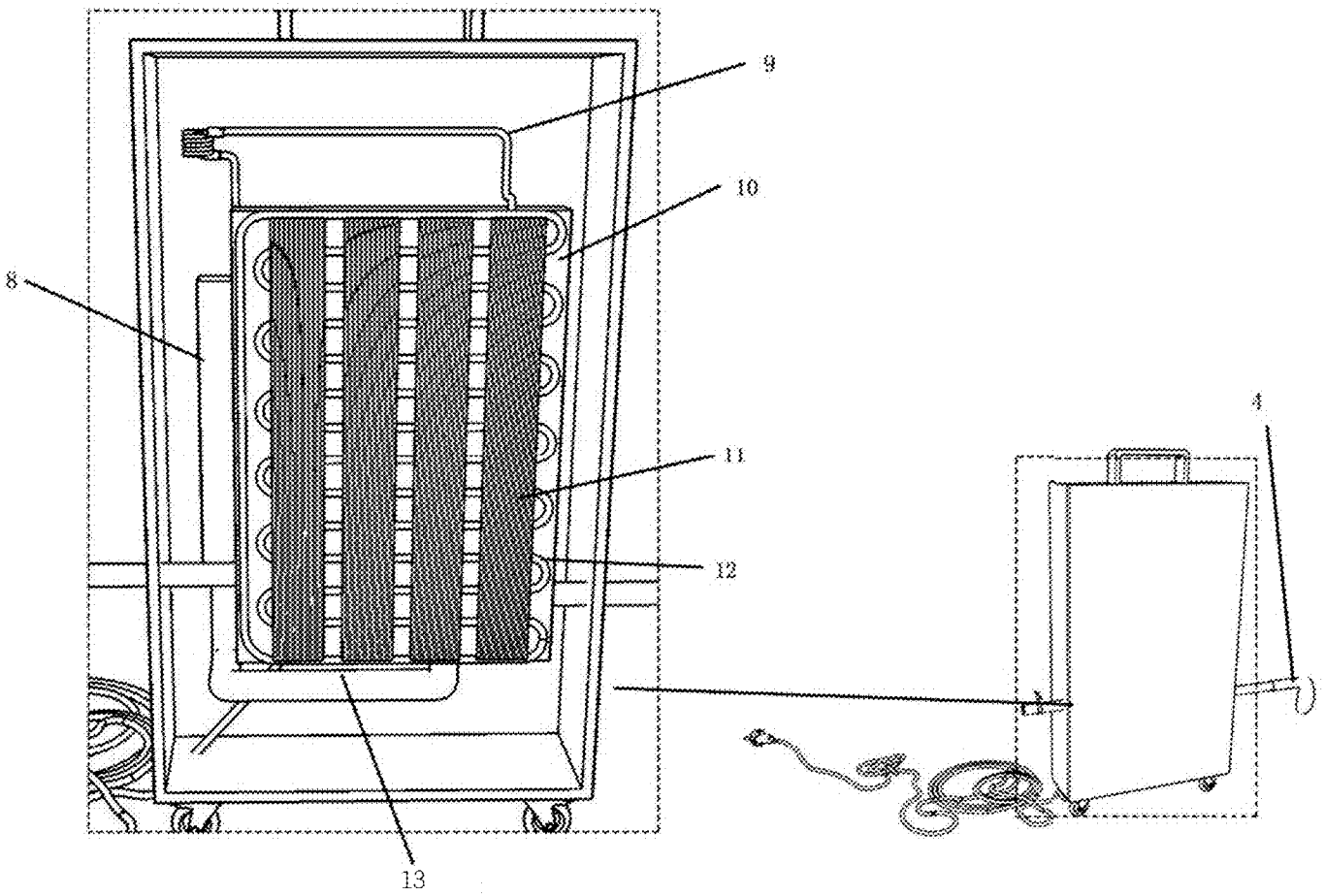
FIG. 2 is an internal schematic diagram of a demolition device according to an embodiment of the invention.

FIG. 2 is an internal schematic diagram of the demolition device. As shown in FIG. 2, the demolition device of this embodiment further includes a compressor 8, a thinner pipe 9, a heating plate 10, a cooling medium 11, a throttle capillary 12 and a thicker pipe 13. The thicker pipe 13 is connected with the water inlet 3, and the throttle capillary 12 is connected to the water outlet pipe 4. The compressor 8 is configured to cool the water flowing into the thicker pipe 13. The cooled water then flows into the thinner pipe 9. The cooled water in the thinner pipe 9 can continuously keep at a low temperature by the cooling medium 11. The cooled water then flows into the throttle capillary 12 and then exits the box of the suitcase through the water outlet pipe 4. In one embodiment, the throttle capillary 12 may be back-shaped. Thus, by keeping cooling the water, the demolition device of the invention may cool the water (liquid state) in the silicone bag 5 into ice (solid state).

In contract, the compressor 8 and the heating plate 10 may be configured together to control the temperature of the water at the water outlet pipe 4. Specifically, the compressor 8 and the heating plate 10 may heat the water in the box of the suitcase, so that the ice in the silicone bag 5 can be converted into water.

In summary, the demolition device of the invention can convert the water in the silicone bag 5 from the liquid state to the solid state or from the solid state to the liquid state through heat conduction. That is, the water in the silicone bag 5 can be solidified or liquefied according to needs.

Figure 3:
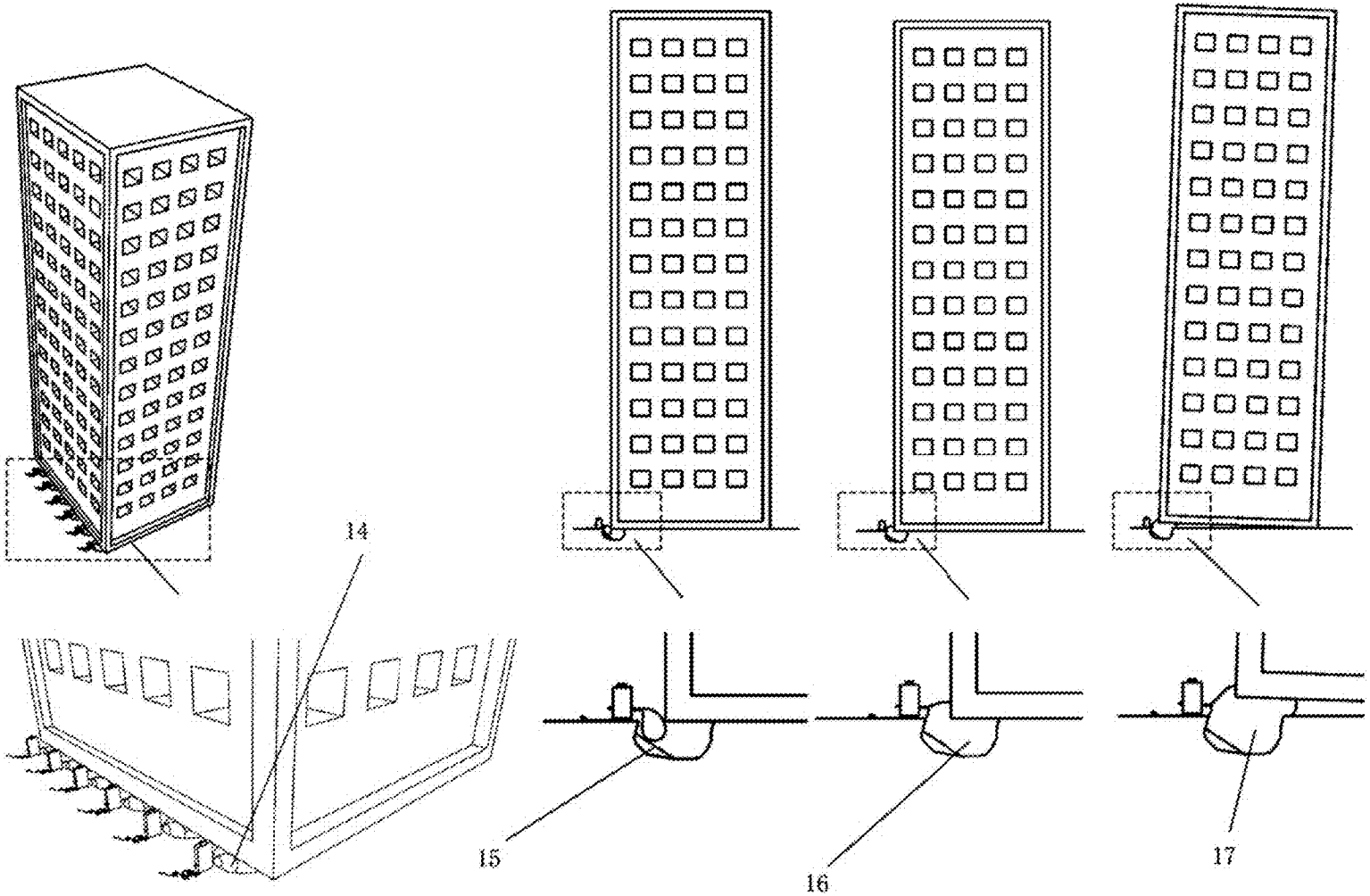
FIG. 3 is a schematic diagram illustrating a process of demolishing a building by a demolition device of the invention.

FIG. 3 is a schematic diagram illustrating a process of demolishing a building by the demolition device of the invention. As shown in FIG. 3, when a building needs to be demolished, a plurality of cavities are dug at the bottom of the building, and a plurality of demolition devices of the invention are arranged regularly, so that the silicone bags 5 of the demolition devices are respectively placed in the cavities (step 14). Then, a steel plate is placed and leaned against on the side of each cavity to increase the support for the silicone bag 5, and the external power cord 6 is connected to a power source (step 15). Then, the silicone bag 5 is filled with water so that the silicone bag 5 fills the respective cavity (step 16). Then, the water (liquid state) is converted to ice (solid state) by the operation of the compressor 8. Because the volume of water in solid state is greater than the volume of water in liquid state, the volume of the silicone bag 5 gets larger and larger to lift the building up (step 17) after repeating aforementioned process many times, thereby eventually achieving the purpose of demolition.

Figure 4:
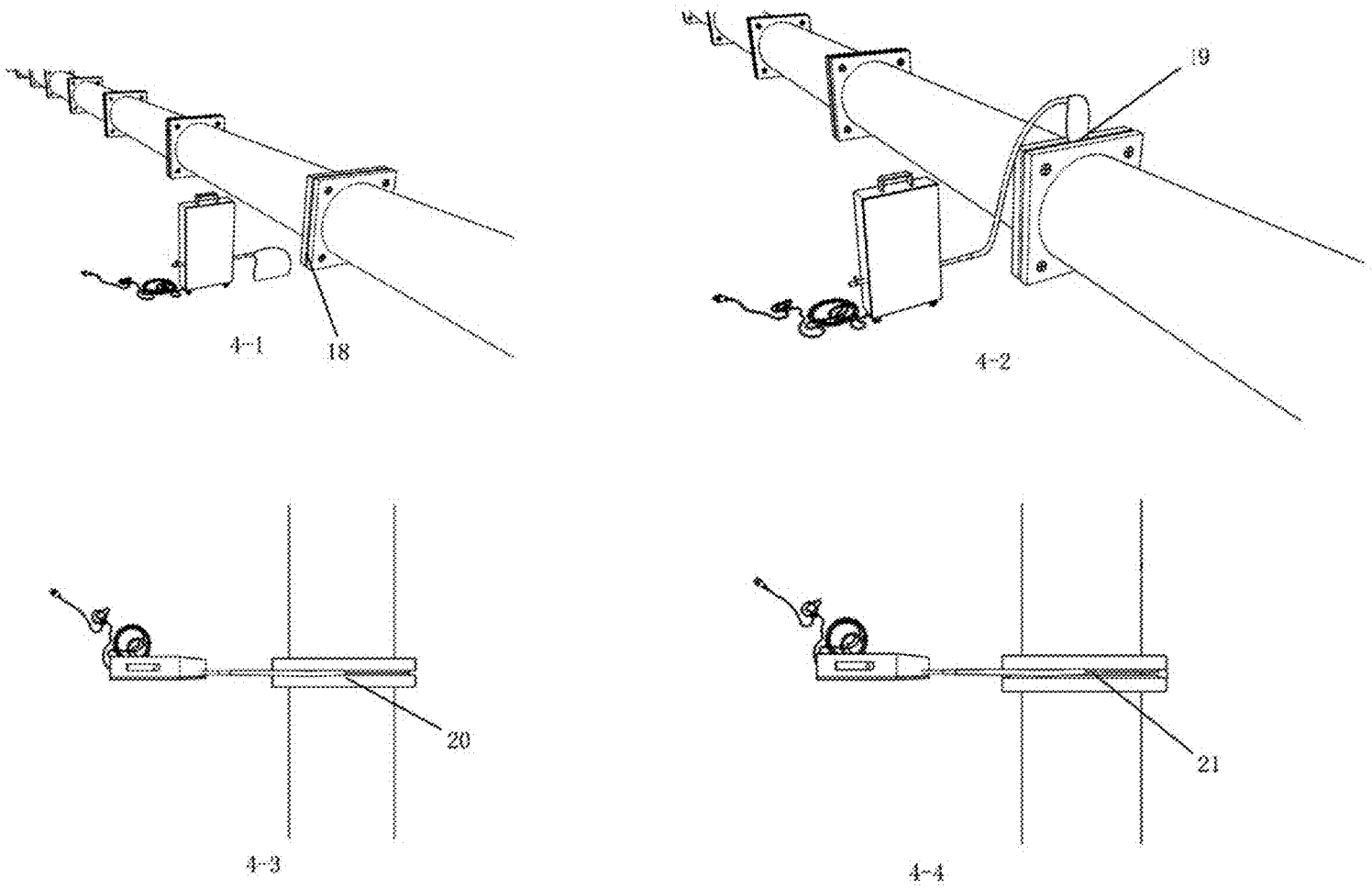
FIG. 4 is a group of schematic diagrams, including FIG. 4-1, FIG. 4-2, FIG. 4-3, and FIG. 4-4, for illustrating a process of demolishing a pipeline by the demolition device of the invention.

FIG. 4 is a group of schematic diagrams for illustrating a process of demolishing a pipeline by the demolition device of the invention. In FIG. 4-1, the connection of the pipeline to be demolished is illustrated (step 18). In FIG. 4-2, the silicone bag 5 is slowly inserted into the gap of the connection of the pipeline (step 19). In FIG. 4-3, the power of the demolition device of the invention is turned on so that the water flows into the silicone bag 5 from the water outlet 4 (step 20), wherein the water in the silicone bag 5 is converted from liquid state to solid state by the operation of the compressor 8, so that the volume of the water in the silicone bag 5 increases. In FIG. 4-4, the aforementioned step in FIG. 4-3 is repeated for many times to causes the gap at the connection of the pipeline to be opened by the increasing volume of the silicone bag 5 (step 21), and finally the demolition of the pipeline is successful.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A portable demolition device, comprising: a suitcase box; a water inlet, located at a lower part of a first side of the suitcase box, for supplying water into the suitcase box; a water outlet pipe, located on a second side of the suitcase box, for conveying the water out of the suitcase box, wherein the first side is opposite to the second side; a silicone bag, located at the second side of the suitcase box and connected to the water outlet pipe; a compressor, located in the suitcase box, for cooling the water in the suitcase box; and a heating plate, located in the suitcase box, for heating the water in the suitcase box; wherein the compressor cools the water into a solid state through heat conduction, and the compressor and the heating plate to heat the water into a liquid state through heat conduction; and wherein the silicone bag is placed within or next to a device desired to be demolished, and the device is demolished as a volume of the silicone bag changes along with the water converted into the liquid state or the solid state.

2. The portable demolition device according to claim 1, further comprising:

a handle, located at a top of the suitcase box; and a plurality of pulleys, located at a bottom of the suitcase box;

wherein the suitcase box is movable by a user through the handle and the plurality of pulleys.

3. The portable demolition device according to claim 1, further comprising:

a water control valve, located at the lower part of the first side of the suitcase box and connected to the water inlet, for controlling the water inlet to be open and close.

4. The portable demolition device according to claim 3, wherein the water starts to flow into the suitcase box when the water control valve opens the water inlet.

5. The portable demolition device according to claim 3, wherein the water stops flowing into the suitcase box when the water control valve closes the water inlet.

6. The portable demolition device according to claim 1, further comprising an external power cord, provided at a bottom of the suitcase box and connected to a power source.

7. The portable demolition device according to claim 1, further comprising a cooling medium, provided in the suitcase box, configured to keep the water in the suitcase box at a lower temperature.

8. The portable demolition device according to claim 1, further comprising a throttle capillary, provided in the suitcase box and connected to the water outlet pipe.

9. The portable demolition device according to claim 8, wherein the throttle capillary is back-shaped.

10. The portable demolition device according to claim 1, wherein the volume of the silicone bag decreases when the water in the silicone bag is converted from the solid state to the liquid state.

* * * * *